US007708846B2

(12) United States Patent
Malley

(10) Patent No.: US 7,708,846 B2
(45) Date of Patent: May 4, 2010

(54) SUPERALLOY STABILIZATION

(75) Inventor: David R. Malley, Bolton, CT (US)

(73) Assignee: United Technologies Corporation, Hartford, CT (US)

( * ) Notice: Subject to any disclaimer, the term of this patent is extended or adjusted under 35 U.S.C. 154(b) by 340 days.

(21) Appl. No.: 11/289,199

(22) Filed: Nov. 28, 2005

(65) Prior Publication Data

US 2007/0119528 A1 May 31, 2007

(51) Int. Cl.
*C22F 1/10* (2006.01)
*C22C 19/05* (2006.01)

(52) U.S. Cl. ..... 148/675; 148/410; 420/449; 420/450

(58) Field of Classification Search ..... 420/442, 420/445, 446, 448, 449, 450, 451, 460
See application file for complete search history.

(56) References Cited

U.S. PATENT DOCUMENTS

| | | | | |
|---|---|---|---|---|
| 3,898,109 | A * | 8/1975 | Shaw | 148/501 |
| 4,465,530 | A * | 8/1984 | Kagohara et al. | 148/410 |
| 4,574,015 | A | 3/1986 | Genereux et al. | |
| 4,624,716 | A * | 11/1986 | Noel et al. | 148/514 |
| 4,907,947 | A | 3/1990 | Hoppin, III | |
| 5,104,614 | A | 4/1992 | Ducrocq et al. | |
| 5,120,373 | A | 6/1992 | Miller et al. | |
| 5,124,123 | A | 6/1992 | Henry | |
| 5,693,159 | A | 12/1997 | Athey et al. | |
| 5,938,863 | A * | 8/1999 | Malley | 148/428 |
| 6,132,527 | A | 10/2000 | Hessell et al. | |
| 6,132,535 | A * | 10/2000 | Okada et al. | 148/677 |
| 6,521,175 | B1 | 2/2003 | Mourer et al. | |
| 6,908,519 | B2 | 6/2005 | Raymond et al. | |
| 2001/0039984 | A1 * | 11/2001 | Nonomura et al. | 148/677 |
| 2002/0053376 | A1 * | 5/2002 | Nonomura et al. | 148/677 |
| 2003/0116242 | A1 * | 6/2003 | Harrison et al. | 148/675 |

FOREIGN PATENT DOCUMENTS

| | | |
|---|---|---|
| EP | 1195446 A1 | 4/2002 |
| EP | 1201777 A1 | 5/2002 |

OTHER PUBLICATIONS

Dietmar Helm and Olaf Roder, Influence of Long Term Exposure in Air on Microstructure, Surface Stability and Mechanical Properties of UDIMET 720LI, 9th International Symposium on Sueralloys, 2000.
Waspaloy, Specialty Metals Corporation, Sep. 2004.
UDIMET Alloy 720, Specialty Metals Corporation, Sep. 2004.

* cited by examiner

*Primary Examiner*—George Wyszomierski
*Assistant Examiner*—Mark L Shevin
(74) *Attorney, Agent, or Firm*—Buchman & La Pointe, P.C.

(57) ABSTRACT

For a group of nickel-based superalloys, improved properties have been obtained by stabilizing at increased temperature for a reduced time relative to prior art specifications. In particular, improved creep properties have been obtained with a one-hour 1800° F. stabilization relative to a prior art four-hour 1500° F. stabilization.

23 Claims, 12 Drawing Sheets

Powder Metal (PM) Alloy "A" Stress-Rupture Properties

| Specimen Number | Stabilization Cycle | Test Temperature (°F) | Test Stress (ksi) | Rupture Life (Hours) | Elongation (%) | Reduction of Area (%) | Failure Location |
|---|---|---|---|---|---|---|---|
| | | | | | | | |
| MJ 2353 | Modified | 1350 | 78 | 46 | 14 | 12 | Smooth |
| MJ 2354 | Modified | 1350 | 78 | 47 | 10 | 14 | Smooth |
| MJ 2355 | Modified | 1350 | 78 | 30 | 8 | 14 | Smooth |
| | | | | | | | |
| MJ 2346 | Prior Art | 1350 | 78 | 17 | – | – | Notched |
| MJ 2347 | Prior Art | 1350 | 78 | 18 | – | – | Notched |
| | | | | | | | |
| Spec. Minima | Prior Art | 1350 | 78 | 23 | 10 | – | Smooth |

FIG.3

Powder Metal (PM) Alloy "A" 1200°F Tensile Properties

| Specimen | Stabilization Cycle | Yield Strength (ksi) | Ultimate Strength (ksi) | Elongation (%) | Reduction of Area (%) |
|---|---|---|---|---|---|
| | | | | | |
| MJ 2518 | Modified | 154 | 199 | 22 | 24 |
| MJ 2519 | Modified | 156 | 200 | 22 | 21 |
| MJ 2520 | Modified | 155 | 200 | 23 | 27 |
| MJ 2521 | Modified | 156 | 198 | 23 | 25 |
| | | | | | |
| MJ 2360 | Prior Art | 160 | 210 | 24 | 23 |
| MJ 2361 | Prior Art | 158 | 205 | 22 | 25 |
| | | | | | |
| Average PM Data | Modified | 155 | 199 | 23 | 24 |
| | Prior Art | 159 | 208 | 23 | 24 |
| | | | | | |
| Average $-2\sigma$ Data | Modified | 153 | 197 | 21 | 19 |
| | Prior Art | 157 | 203 | 21 | 22 |
| | | | | | |
| Spec. Minima | Prior Art | 140 | 185 | 12 | 12 |

FIG.4

Powder Metal (PM) Alloy "A" Creep Properties

| Specimen | Stabilization Cycle | Test Temperature (°F) | Test Stress (ksi) | Time to 0.1% Creep (Hours) | Time to 0.2% Creep (Hours) |
|---|---|---|---|---|---|
| | | | | | |
| MJ 2649 | Modified | 1250 | 100 | 18 | 49 |
| MJ 2317 | Prior Art | 1250 | 100 | 20 | 37 |
| MJ 2318 | Prior Art | 1250 | 100 | 20 | 32 |
| MJ 2319 | Prior Art | 1250 | 100 | 6 | 15 |
| MJ 2320 | Prior Art | 1250 | 100 | 10 | 22 |
| | | | | | |
| MJ 2650 | Modified | 1300 | 70 | 115 | 144 |
| MJ 2651 | Modified | 1300 | 70 | 136 | 198 |
| MJ 2321 | Prior Art | 1300 | 70 | 20 | 38 |
| MJ 2322 | Prior Art | 1300 | 70 | 18 | 31 |
| MJ 2323 | Prior Art | 1300 | 70 | 14 | 27 |
| MJ 2324 | Prior Art | 1300 | 70 | 18 | 32 |
| | | | | | |
| Spec. Minima | Prior Art | 1300 | 70 | – | 31 |
| | | | | | |
| MJ 2652 | Modified | 1350 | 30 | 88 | 121 |
| MJ 2325 | Prior Art | 1350 | 30 | 30 | 57 |
| MJ 2326 | Prior Art | 1350 | 30 | 34 | 64 |
| MJ 2327 | Prior Art | 1350 | 30 | 27 | 58 |
| MJ 2328 | Prior Art | 1350 | 30 | 34 | 63 |

FIG.5

Conventional Wrought Alloy "A" Tensile Properties

| Specimen | Temperature (°F) | Yield Strength (ksi) | Ultimate Tensile Strength (ksi) | Elongation (%) | Reduction of Area (%) |
|---|---|---|---|---|---|
| MJ 2510 | 1200 | 152 | 200 | 27 | 28 |
| MJ 2511 | 1200 | 151 | 199 | 29 | 31 |
| MJ 2512 | 1200 | 152 | 200 | 24 | 28 |
| MJ 2513 | 1200 | 151 | 199 | 24 | 26 |
| | | | | | |
| Average | 1200 | 151 | 199 | 26 | 28 |
| Avg.−2σ | 1200 | 150 | 198 | 22 | 25 |
| | | | | | |
| Database Avg. | 1200 | 157 | 194 | 23 | 28 |
| | | | | | |
| Spec. Minima | 1200 | 140 | 185 | 12 | 12 |

FIG. 7

Conventional Wrought Alloy "A" Creep Properties

| Specimen | Stabilization Cycle | Temperature (°F) | Test Stress (ksi) | Time to 0.2% Creep (Hours) |
|---|---|---|---|---|
| | | | | |
| MJ 2514 | Modified | 1300 | 70 | 111 |
| MJ 2515 | Modified | 1300 | 70 | 97 |
| MJ 2516 | Modified | 1300 | 70 | 122 |
| | | | | |
| Database Avg. | Prior Art | 1300 | 70 | 63 |
| Spec. Minima | Prior Art | 1300 | 70 | 31 |
| | | | | |
| MJ 2517 | Modified | 1300 | 40 | 531 |
| Database Avg. | Prior Art | 1300 | 40 | 370 |
| Spec. Minima | Prior Art | 1300 | 40 | 173 |

FIG.8

Conventional Wrought Alloy "C" Alloy Creep Properties

| Specimen | Stabilization Cycle | Test Temperature (°F) | Test Stress (ksi) | Time to 0.2% Creep (Hours) |
|---|---|---|---|---|
| | | | | |
| MJ 2550 | Modified | 1250 | 100 | 28 |
| MJ 2551 | Modified | 1250 | 100 | 35 |
| | Prior Art | 1250 | 100 | Not tested |
| | | | | |
| MJ 2546 | Modified | 1300 | 70 | 43 |
| MJ 2547 | Modified | 1300 | 70 | 48 |
| MJ 2548 | Modified | 1300 | 70 | 40 |
| MJ 2549 | Modified | 1300 | 70 | 42 |
| | Prior Art | 1300 | 70 | 7 |
| Spec. Minima | Prior Art | 1300 | 70 | 31 |
| | | | | |
| MJ 2552 | Modified | 1400 | 20 | 18 |
| MJ 2553 | Modified | 1400 | 20 | 16 |
| | Prior Art | 1400 | 20 | 19 |

FIG.10

Conventional Wrought Alloy "B" Creep Properties

| Specimen | Stabilization Cycle | Test Temperature (°F) | Test Stress (ksi) | Time to 0.2% Creep (Hours) |
|---|---|---|---|---|
| | | | | |
| MJ 2635 | Modified | 1250 | 100 | 262 |
| MJ 2636 | Modified | 1250 | 100 | 297 |
| MJ 2633 | Modified | 1300 | 70 | 352 |
| MJ 2634 | Modified | 1300 | 70 | 323 |
| MJ 2637 | Modified | 1400 | 20 | 148 |
| MJ 2638 | Modified | 1400 | 20 | 172 |
| | | | | |
| MJ 2640 | Prior Art "Yo-Yo" | 1250 | 100 | 127 |
| MJ 2642 | Prior Art "Yo-Yo" | 1250 | 100 | 148 |
| MJ 2639 | Prior Art "Yo-Yo" | 1300 | 70 | 197 |
| MJ 2641 | Prior Art "Yo-Yo" | 1300 | 70 | 110 |
| MJ 2643 | Prior Art "Yo-Yo" | 1400 | 20 | 154 |
| MJ 2644 | Prior Art "Yo-Yo" | 1400 | 20 | 135 |
| | | | | |
| Database | Prior Art | 1250 | 100 | 20 |
| Database | Prior Art | 1300 | 70 | 24 |
| Database | Prior Art | 1400 | 20 | 26 |

FIG. 12

SUPERALLOY STABILIZATION

BACKGROUND OF THE INVENTION

The invention relates to heat treatment of superalloys. More particularly, the invention relates to stabilization of nickel-based alloys for disks and other gas turbine engine rotating parts.

The combustion, turbine, and exhaust sections of gas turbine engines are subject to extreme heating as are latter portions of the compressor section. This heating imposes substantial material constraints on components of these sections. One area of particular importance involves structural rotating parts such as blade-bearing turbine disks and shafts. The disks are subject to extreme mechanical stresses, in addition to the thermal stresses, for significant periods of time during engine operation. Shafts are subject to somewhat similar stresses and variant alloys have been developed for shaft use.

Exotic materials have been developed to address the demands of turbine disk use. Shafts are subject to somewhat similar stresses and variant alloys have been developed for shaft use. Separately, other materials have been proposed to address the demands of turbine blade use. Turbine section blades are typically cast and some blades include complex internal features.

U.S. Pat. Nos. 5,120,373 and 5,938,863 disclose advanced nickel-base superalloys. One commercial disk alloy embodiment of such an alloy has a nominal composition of 16.0Cr, 13.5Co, 4.15Mo, 4.6Ti, 2.2Al, 0.07Zr, 0.006B, 0.0025Mg, balance Ni, by weight percent. For reference, this alloy is identified as alloy "A" hereafter. A commercial shaft alloy variant has a nominal composition of 15.75Cr, 13.5Co, 4.15Mo, 4.6Ti, 2.2Al, 0.07Zr, 0.006B, 0.0025Mg, balance Ni, by weight percent. For reference, this alloy is identified as alloy "B" hereafter. Alloy "B" is a higher tensile strength alloy. Both are used in a conventionally processed (not powder metallurgical) form.

U.S. Pat. No. 6,521,175 discloses an advanced nickel-base superalloy for powder metallurgical manufacture of turbine disks. The '175 patent discloses disk alloys optimized for short-time engine cycles, with disk temperatures approaching temperatures of about 1500° F. (816° C.). Other disk alloys are disclosed in U.S. Pat. No. 5,104,614, US2004221927, EP1201777, and EP1195446.

An exemplary processing of a forging includes: solution treatment; stabilization; and age hardening stages. Exemplary solution treatment comprises heating to a high temperature effective to remove prior precipitate phases (principally gamma prime (γ')). An exemplary temperature is in excess of 1900° F. (e.g., 1910-2015° F. in standard alloy "A" processing with an upper limit reflecting a desired control of grain size). Such a temperature is maintained for an interval effective to achieve desired precipitate phase removal (e.g., two hours in standard (prior art) alloy "A" processing). Air cooling or a faster cooling rate is then performed to rapidly decrease temperature to avoid precipitate formation at undesirable intermediate temperatures. An exemplary cooling is to a temperature near or below 1000° F.

Stabilization serves to form carbides at grain boundaries. Exemplary stabilization comprises heating at an intermediate temperature effective to form sufficient carbides to stabilize the grain boundaries (e.g., 1500+/−25° F. in standard alloy "A" processing). Such a temperature is maintained for an interval effective to achieve the desired carbide formation (e.g., four hours in standard alloy "A" processing). Fan air cooling or an equivalent is then performed to similarly avoid any precipitate formation at undesirable intermediate temperatures. An exemplary cooling is to a temperature near or below 1000° F.

Age hardening (precipitation heat treatment) serves to grow desired γ' within the γ matrix. Exemplary age hardening comprises heating at a lower temperature and for a time effective to grow a desired size and volume fraction of γ' (e.g., 1350+/−25° F. for eight hours in standard alloy "A" processing). Air cooling or fan air cooling is then performed to rapidly terminate γ' formation.

SUMMARY OF THE INVENTION

For a group of nickel-based superalloys, improved properties have been obtained by stabilizing at increased temperature for a reduced time relative to prior art specifications.

Experimentally, for alloys whose standard prior art stabilization is four hours at 1500° F., improved creep properties have been obtained with a one-hour 1800° F. stabilization.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

FIG. 3 is a table of stress-rupture properties of powder metal alloy "A".

FIG. 4 is a table of 1200° F. tensile properties of powder metal alloy "A".

FIG. 5 is a table of creep properties of powder metal alloy "A".

FIG. 7 is a table of tensile properties of conventional alloy "A".

FIG. 8 is a table of creep properties of conventional alloy "A".

FIG. 10 is a table of creep properties of conventional alloy "C".

FIG. 12 is a table of creep properties of conventional alloy "B".

Like reference numbers and designations in the various drawings indicate like elements.

DETAILED DESCRIPTION

Figure 1:
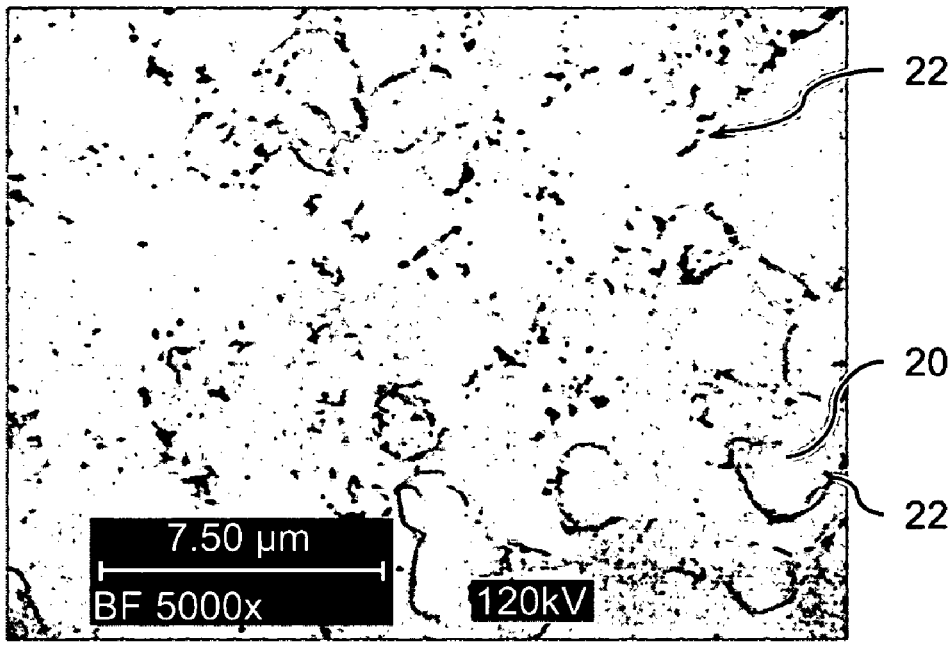
FIG. 1 (PRIOR ART)
FIG. 1 is a photomicrograph of alloy "A" after a prior art heat treatment.

A relatively short duration, high temperature stabilization cycle has been found to provide improved properties. In a specific example, substituting an 1800° F., one-hour stabilization cycle for the standard 1500° F., four-hour cycle has been demonstrated to substantially improve creep and stress-rupture properties of both cast/wrought and powder metal (PM) versions of several nickel-base superalloys.

As discussed below, tested alloys include production alloys "A" and "B" and an experimental alloy "C". Alloy "C" was derived from alloy "A" as an improved low cycle fatigue (LCF) variant principally through reduced Mo content. With prior art heat treatment, Alloy "C" has improved smooth and notched LCF properties. However, those improvements came at the expense of lower stress-rupture (SR) and creep properties. Alloy "C" has a composition within U.S. Pat. No. 5,938,863. Nominal alloy "C" composition is 2.2Al, 4.6Ti, 15.5Cr, 3.0Mo, 13.5Co, 0.015C, 0.015B, 0.04Zr, 0.002Mg, balance essentially Ni, by weight percent.

Other strong superalloys may also benefit from the present modified heat treatment. This may be particularly relevant for alloys whose prior art stabilization cycles are in the 1500-1600° F. range. For example, Udimet 700 and 720LI alloys (Special Metals Corp., New Hartford, N.Y., referenced in U.S. Pat. No. 6,132,527), Astroloy (UNS N13017) and standard Waspaloy (UNS N07001 and Werkstoff Number 2.4654), all typically used in non-PM wrought form, and alloy IN 738, typically used in cast form (e.g., a TOBI duct, turbine exhaust case, and the like), have specified prior art stabilization in the 1500-1600° F. range. The nominal, composition of Udimet 720LI alloy is 16Cr, 14.7Co, 3.0Mo, 1.25W, 5.0Ti, 2.5Al, 0.010C, 0.015B, 0.03Zr, balance essentially Ni, by weight percent. Among differences relative to alloys "A" and "B", Udimet 720LI has a tungsten content whereas the others have essentially none. Udimet 720LI also has a relatively low molybdenum content and a relatively high titanium content.

Specifically, the modified stabilization had no detrimental effect on dwell da/dN (fracture mechanics) behavior of PM alloy "A" which was the only material so tested. Further testing demonstrated that the microstructural damage caused by prior art stabilization at 1500-1600° F. cannot be reversed without a re-solution treatment. The modified stabilization also improved the properties of non-PM alloy "C", with significant improvements in SR and creep behavior.

Powder Metallurgical (PM) Testing

In a prior art treatment, PM alloy "A" forgings were solutioned at 2030° F. for two hours followed by an oil quench. The forgings were then stabilized at 1500° F. for four hours followed by a four hour fan air cool (FAC). The forgings were then aged at 1350° F. for eight hours followed by FAC. Similar forgings were prepared using the inventive ("modified") heat treatment substituting an 1800° F., one-hour stabilization cycle for the standard 1500° F., four-hour cycle.

Figure 2:
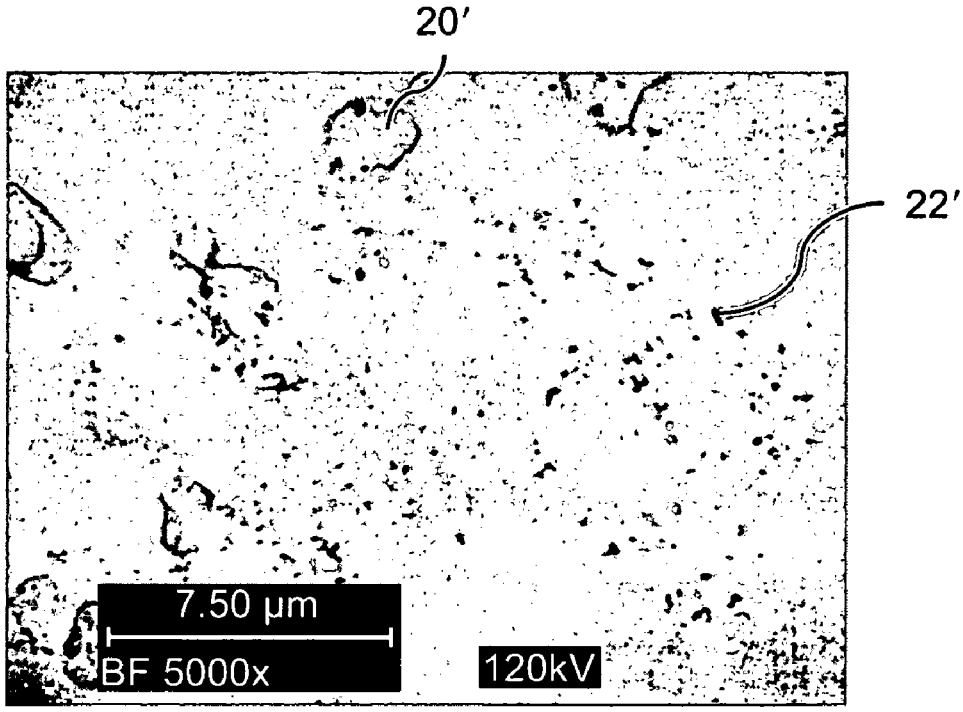
FIG. 2 is a photomicrograph of alloy "A" after heat treatment with an inventive modified stabilization.

FIG. 1 shows the exemplary prior art microstrucure with light areas representing matrix, including γ' phases 20. Dark spots represent carbides (including $M_{23}C_6$) and/or borides 22. FIG. 2 shows microstructure produced by the exemplary modified heat treatment. It appears that the 1800° F. stabilization cycle spheroidizes the carbides and/or borides 22' relative to those of the prior art and may reduce their size.

The initial SR testing of extruded powder material with the standard alloy "A" stabilization cycle demonstrated properties that failed the conventional (non-PM) alloy "A" specification minima (FIG. 3).

The standard stabilization cycle of PM alloy "A" material encountered low lives/ductilities and notch failures.

Several PM alloy "A" finish machined specimens with the prior art heat treatment were re-solutioned and then stabilized according to the modified stabilization. Re-solutioning was in vacuum at 1975° F. for two hours then fan air cooled (the low solution temperature avoided grain growth). Stabilization was at 1800° F. for one hour followed by a forced argon cool (FArC). Age hardening was at 1350° F. for eight hours followed by FArC. This procedure produced no dimensional distortion. Rupture lives were increased by a factor of two to three (FIG. 3) while notch failures were eliminated and no grain coarsening occurred. Thus, at least in the tested alloy, the improvement changed a notch-weakened condition to a notch-strengthened condition.

Tensile testing at 1200° F. (FIG. 4) showed a very minor decrease in ultimate tensile strength for material that received the modified stabilization relative to the prior art. However, all tensile data well exceeded the alloy "A" specification minima on a $-2\sigma$ statistical basis. The modified stabilization cycle was found to eliminate unusual "double shear lip" failures encountered in some PM alloy "A" tensile specimens.

Figure 6:
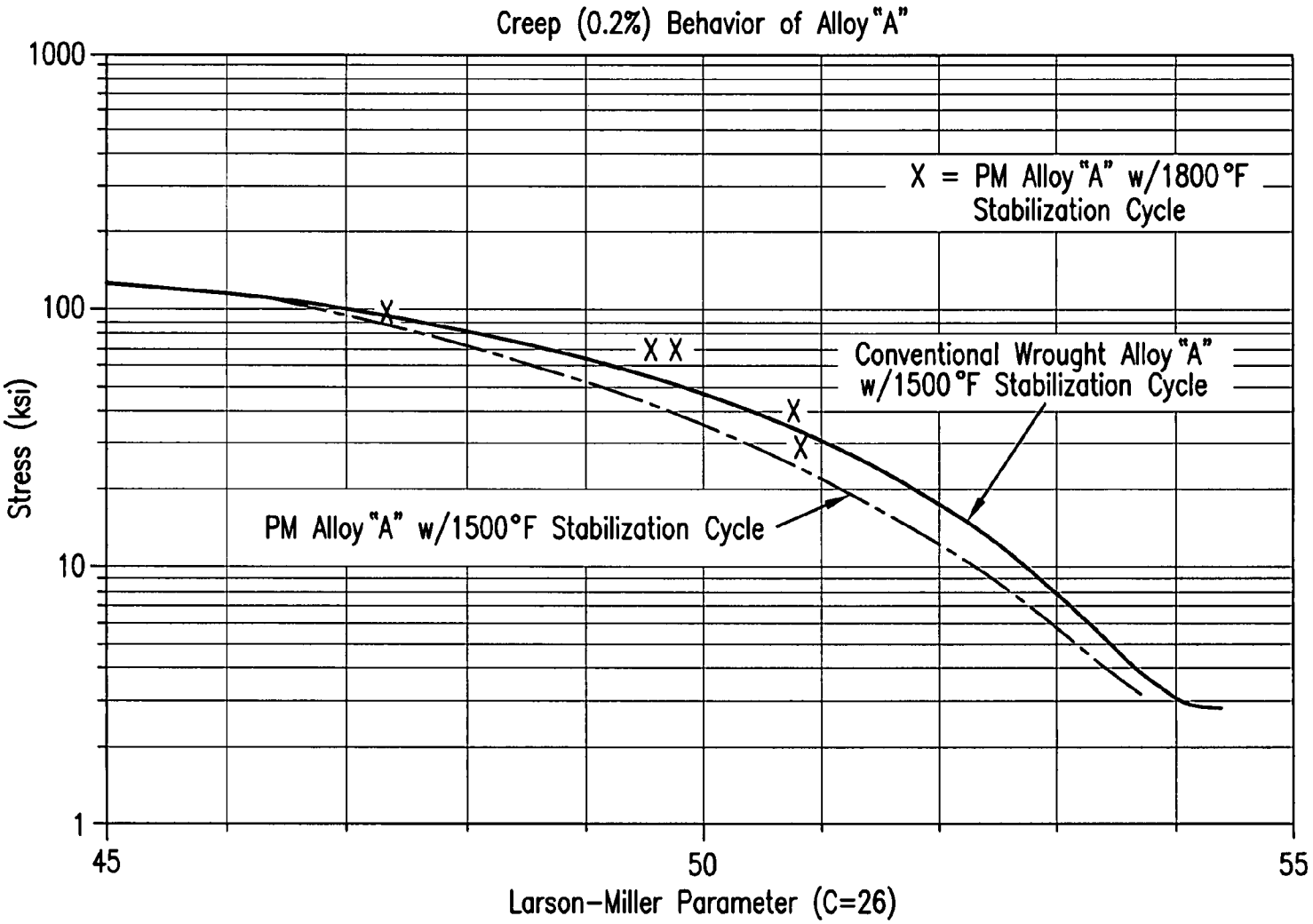
FIG. 6 are Larson-Miller curves for alloy "A".

The modified stabilization cycle also improved creep properties (FIGS. 5 and 6). The modified stabilization cycle had no impact on dwell crack growth behavior. It appears from FIG. 2 that $M_{23}C_6$ carbides and/or borides are spheroidized by the 1800° F. stabilization cycle. This may have decreased the minimum creep rate, resulting in an overall improvement in creep performance with the majority of creep in Stage III.

Conventional (Non-PM) Testing

In the past, conventional wrought alloy "A" with prior art heat treatment occasionally did not meet specification creep requirements. Coarsening the grain size by increasing the solution temperature typically improves creep capability. However, the alloy's γ' solvus temperature is too low to allow this without encountering excessive grain growth. Grain growth would benefit creep, stress-rupture, and da/dN properties. However, grain growth has a negative effect on tensile strength and fatigue properties. These countervailing factors have restricted attempts to achieve an advantageous balance of these properties.

A slower cooling rate during the superoverage (SOA) cycle (e.g., U.S. Pat. No. 4,574,015) used in billet manufacturing possibly could increase the primary γ' particle spacing and produce a somewhat coarser, controllable grain size. However, this approach was not tested.

Figure 9:
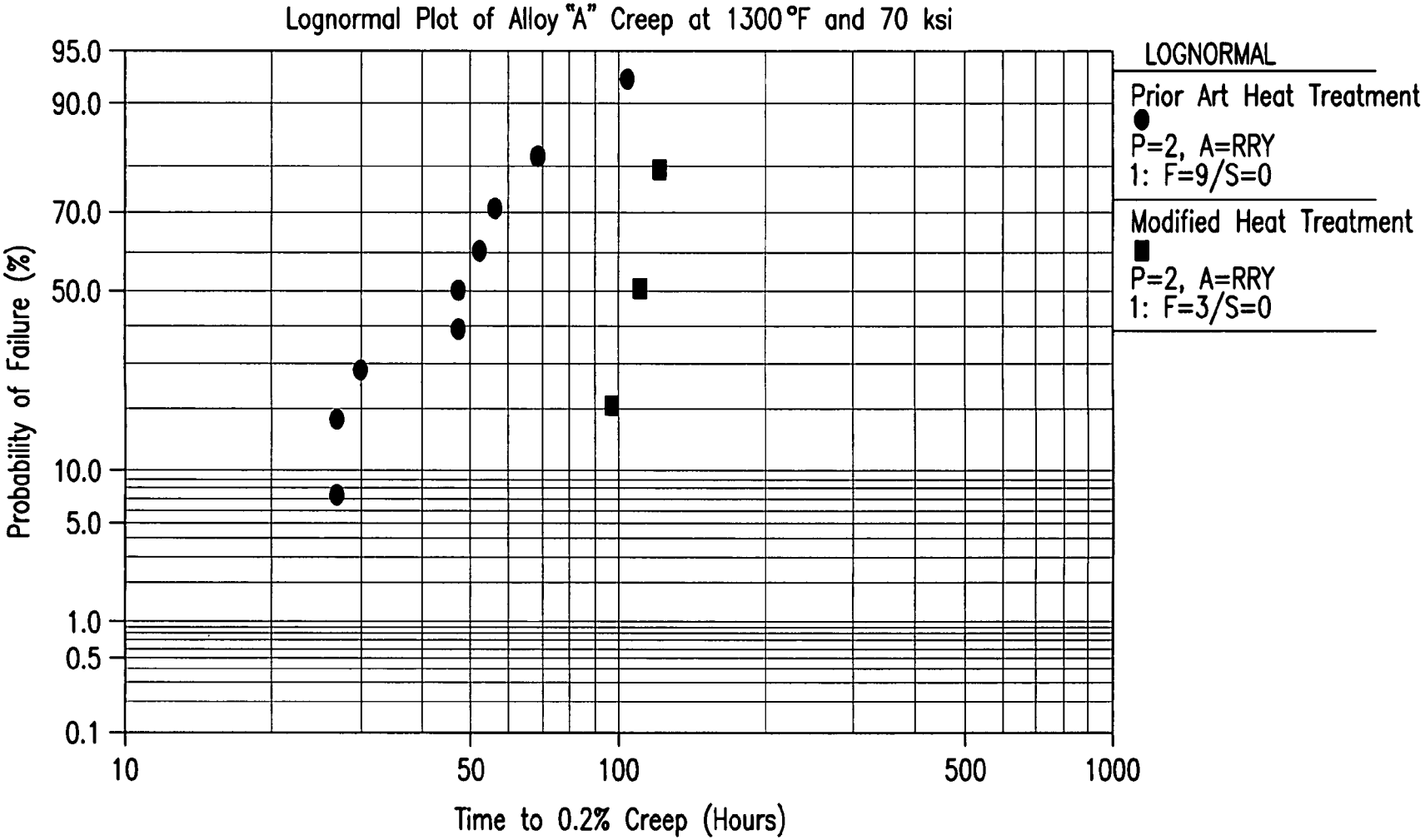
FIG. 9 is lognormal plot of creep for conventional alloy "A".

In a different approach, conventional alloy "A" was re-solutioned (1975° F. for two hours followed by FAC). It was then stabilized/aged using the modified stabilization cycle discussed above. This allowed evaluation of the benefit of the modified stabilization cycle while avoiding the possibility of grain growth similar to that used for the PM version of alloy "A". FIG. 7 shows that the 1200° F. tensile properties of conventionally processed (non-PM) alloy "A" experienced only a minor decrease in tensile yield/UTS with no effect on ductility. Specification tensile property requirements were well satisfied. Creep testing conducted at 1300° F./40 ksi and 1300° F./70 ksi showed improvements ranging from 45-75% at least through 1300° F. (FIGS. 8 and 9). Thus, the modified stabilization cycle produced creep lives which substantially exceeded the specification requirements.

Figure 11:
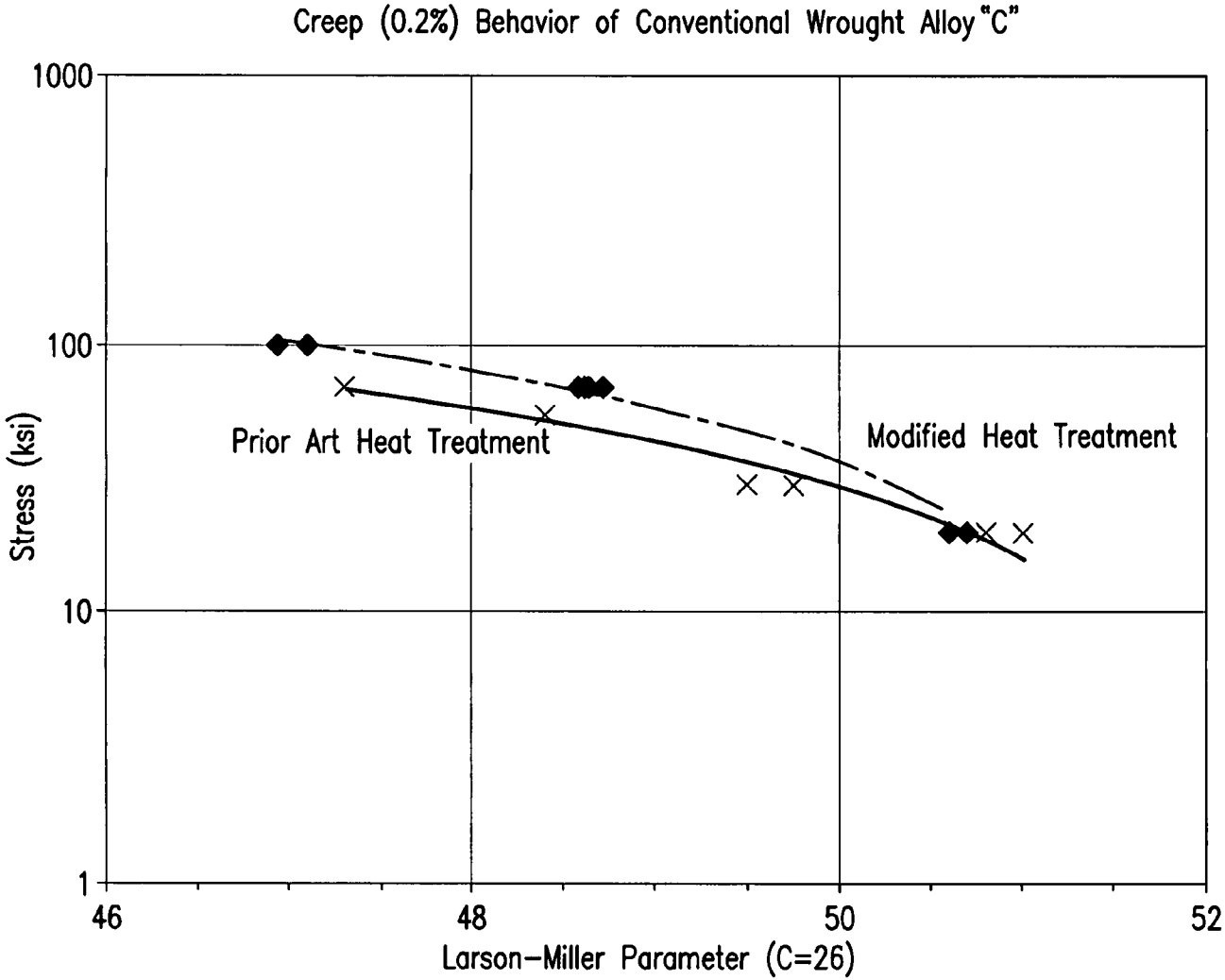
FIG. 11 is a Larson-Miller curve for alloy "C".

For alloy "C", initially, creep properties were determined using the standard alloy "A" heat treatment. Additional creep specimens were machined from material processed through the modified 1800° F. stabilization cycle. Test data (FIGS. 10 and 11) showed a substantial improvement.

It was theorized that a "yo-yo" heat treatment might provide an improved balance between nucleation and growth of the carbides and/or borides in the alloy and thus improve creep behavior.

Alloy "B" was used in the following test as an expedient because available alloy "C" material had been consumed and these two alloys have similar compositions with the principal exception of molybdenum. The material was re-solutioned at 1975° F. and given either the modified stabilization cycle or an alternative prior art "yo-yo" heat treatment (see, e.g., U.S. Pat. No. 4,907,947). The solution temperature was at the high end of the alloy "B" specification range to be compatible with the prior alloy "A" work. It is noted that 1975° F. is the upper end of a specification solution temperature of 1900-1975° F. The remainder of the alloy "B" specification heat treatment coincides with that of alloy "A".

The "yo-yo" stabilization involved a 40-minute 1600° F. interval, then FAC, then a 45-minute 1800° F. interval, then FAC. The "yo-yo" aging followed with a 24-hour 1200° F. interval, then ambient air cooling (AC), then a 4-hour 1400° F., then AC.

Figure 13:
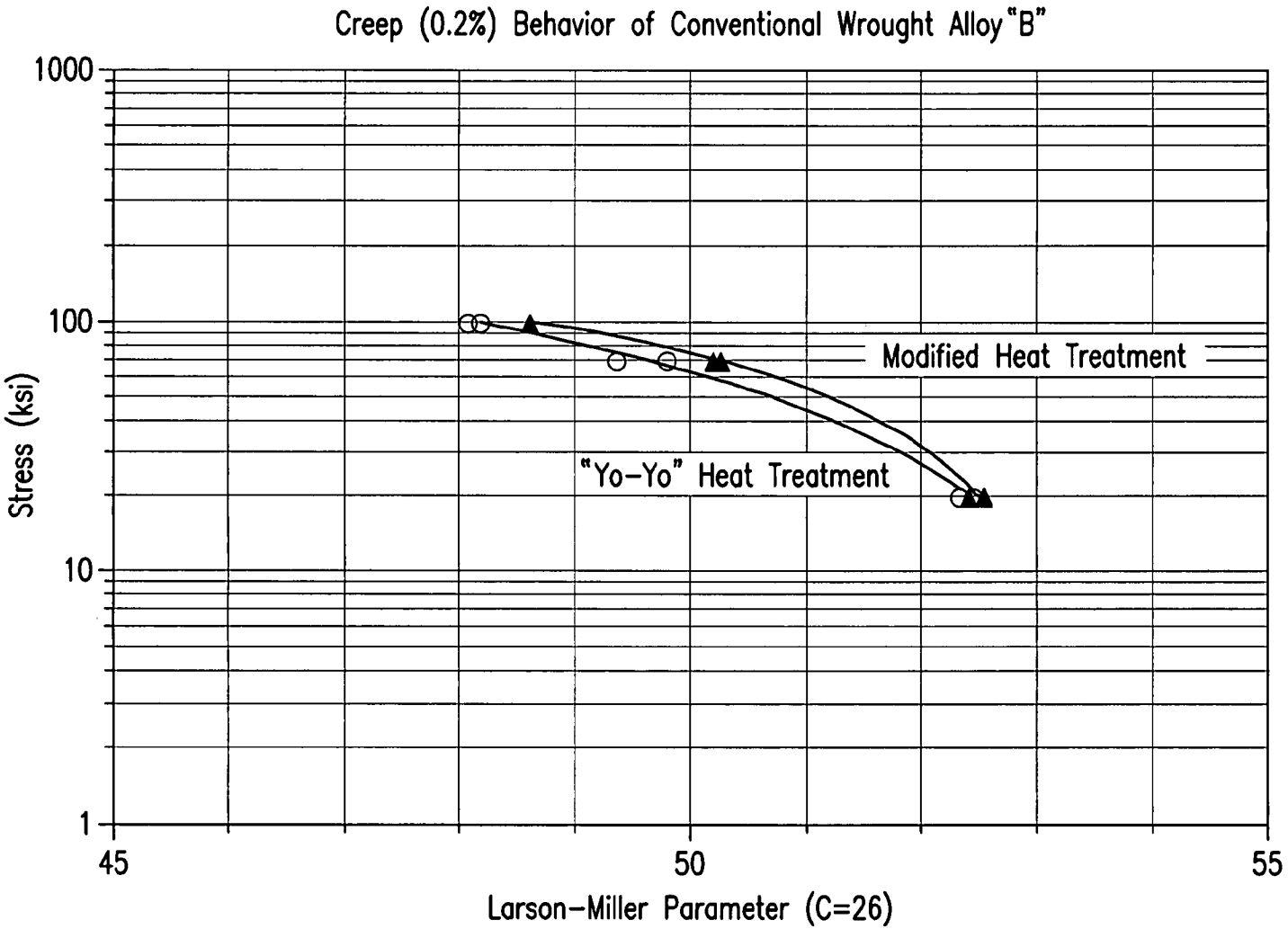
FIG. 13 is a Larson-Miller curve for alloy "B".

FIGS. 12 and 13 show alloy "B" creep results from 1250-1400° F. The modified heat treatment increased typical creep properties by an order of magnitude relative to the standard. This may have been caused by grain coarsening. However, the data shows that the "yo-yo" heat treatment produced properties that were inferior to the 1800° F. stabilization cycle over the range tested. Both sets of alloy "B" material were observed to have the same grain size after these heat treatment. Thus, the microstructural damage encountered at 1500-1600° F. apparently cannot be recovered in this alloy without re-solutioning.

Typical shaft applications for alloy "B" involve temperatures below where creep is a concern. However, the improve creep performance indicates that the modified stabilization cycle may be useful for similar alloys in higher temperature applications.

CONCLUSIONS

In conclusion, lower than desired creep properties in alloy "A" and derivative/similar alloys have been significantly improved by changing the four-hour 1500° F. stabilization cycle to a one-hour 1800° F. cycle. This temperature increase and duration decrease produced a substantial improvement in both creep and stress-rupture properties for both conventional and PM forms of alloy "A". The alloy "C" compositional modification of alloy "A" as well as alloy "B" also benefited from this stabilization cycle change.

Ultimate tensile strength at 1200° F. showed a slight decrease but remained well above the specification requirements. The slightness of the decrease may provide an indication that further refinement could produce at least a slight increase.

The tests across several compositions provide an indication of broader applicability.

One or more embodiments of the present invention have been described. Nevertheless, it will be understood that various modifications may be made without departing from the spirit and scope of the invention. Accordingly, other embodiments are within the scope of the following claims.

What is claimed is:

1. A method for heat treating a superalloy workpiece, the workpiece comprising 2.0-3.0% Al, 12.0-15.5% cobalt, and 14.5-17.0% chromium, the method comprising:

solution treatment stabilization; and age hardening, wherein the stabilization comprises:

heating at a temperature in the range of 1650-1850° F. for a time of 0.5-2.0 hour.

2. The method of claim 1 wherein:

the stabilization temperature and time are effective to provide:

a 1350° F./78 ksi rupture life of at least 25 hours;

a 1250° F./100 ksi time to 0.1% creep of at least 15 hours;

a 1250° F./100 ksi time to 0.2% creep of at least 30 hours;

a 1300° F./70 ksi time to 0.1% creep of at least 100 hours;

a 1300° F./70 ksi time to 0.2% creep of at least 130 hours;

a 1350° F./30 ksi time to 0.1% creep of at least 70 hours; and a 1350° F./30 ksi time to 0.2% creep of at least 110 hours.

3. The method of claim 1 wherein:

the stabilization temperature and time are effective to provide:

a notch-strengthened condition as determined in a 1350° F./78 ksi rupture test.

4. The method of claim 1 wherein:

the stabilization temperature and time are effective to provide improved creep resistance relative to an alternative stabilization at 1500° F. for a time of 4.0 hours.

5. The method of claim 1 wherein:

the stabilization temperature and time are effective to provide improved creep resistance relative to a baseline stabilization at a baseline temperature in a temperature range of 1500-1600° F. for a baseline time in a time range of at least 3.0 hours, the baseline temperature and baseline time providing a maximum creep resistance available within said temperature range and time range.

6. The method of claim 1 wherein:

the solution treatment comprises heating to a temperature of no less than 1950° F.; and the age hardening comprises heating to a temperature no more than 1400° F.

7. The method of claim 1 wherein:

the stabilization temperature is 1750-1850° F. and stabilization time is 0.5-1.5 hour.

8. The method of claim 1 wherein:

the stabilization temperature is 1775-1825° F. and stabilization time is 0.75-1.25 hour.

9. The method of claim 1 wherein:

the stabilization temperature is 1800° F. and stabilization time is one hour.

10. The method of claim 1 wherein:

the solutioning is a re-solutioning.

11. The method of claim 1 wherein:

the workpiece is a powder metal forging.

12. The method of claim 1 wherein:

the workpiece is a non-powder metal wrought forging.

13. The method of claim 1 wherein:

the workpiece is a gas turbine engine disk, seal, sideplate or shaft.

14. The method of claim 1 wherein:

the workpiece has a composition comprising, in weight percent:

majority Ni;

said 14.5-17.0Cr;

12.0-15.0 said Co;

3.45-4.85Mo;

4.45-4.75Ti;

2.0-2.4 said Al;

0.02-0.12Zr;

0.005-0.04C;

0.003-0.01B; and 0.001-0.005Mg.

15. The method of claim 1 wherein:

the workpiece has a composition comprising, in weight percent:

majority Ni;

said 14.5-17.0Cr;

12.0-15.0 said Co;
3.45-4.85Mo;
4.45-4.75Ti;
2.0-2.4 said Al;
0.02-0.12Zr; and
0.003-0.02B.

16. The method of claim 1 wherein:
the workpiece has a composition comprising, in weight percent:
majority Ni;
said 14.5-17.0Cr;
said 12.0-15.5Co;
2.5-5.05Mo;
4.0-5.5Ti; and
said 2.0-3.0Al.

17. The method of claim 16 wherein:
the workpiece composition further comprises, in weight percent:
0.5-1.5W;
0.005-0.020C;
0.02-0.12Zr; and
0.003-0.02B.

18. A method for heat treating a superalloy workpiece comprising:
solution treatment;
stabilization; and
age hardening,
wherein:
the stabilization is at a temperature and time effective to provide:
a 1350° F./78 ksi rupture life of at least 25 hours;
a 1250° F./100 ksi time to 0.1% creep of at least 15 hours;
a 1250° F./100 ksi time to 0.2% creep of at least 30 hours;
a 1300° F./70 ksi time to 0.1% creep of at least 100 hours;
a 1300° F./70 ksi time to 0.2% creep of at least 130 hours;
a 1350° F./30 ksi time to 0.1% creep of at least 70 hours; and
a 1350° F./30 ksi time to 0.2% creep of at least 110 hours; and
the workpiece has a composition comprising, in weight percent:
majority Ni;
14.5-17.0Cr;
12.0-15.0Co;
3.45-4.85Mo;
4.45-4.75Ti;
2.0-2.4Al;
0.02-0.12Zr;
0.003-0.02B; and
0.0-0.05W.

19. The method of claim 18 wherein the temperature and time are further effective to provide:
a 1200° F. yield strength of at least 150 ksi; and
a 1200° F. ultimate tensile strength of at least 190 ksi.

20. A method for heat treating a nickel-based superalloy workpiece comprising:
solution treatment;
stabilization; and
age hardening,
wherein:
the stabilization is at a temperature and time effective to provide improved properties relative to properties of a baseline workpiece;
the baseline workpiece is of identical by-weight component composition to the workpiece;
wherein the by-weight component composition comprises:
majority Ni;
14.5-17.0 Cr;
12.0-15.0 Co;
3.45-4.85 Mo;
4.45-4.75 Ti;
2.0-2.4 Al;
0.02-0.12 Zr;
0.003-0.02 B; and
0.0-0.05 W
the baseline workpiece has a baseline heat treatment having:
a baseline solution treatment;
a baseline stabilization including a stabilization temperature of 1500-1600° F. for 3-5 hours; and
a baseline age hardening; and
the improved properties include at least one of:
at least a 50% increase in 1350° F./78 ksi rupture life;
at least a 50% increase in 1250° F./100 ksi time to 0.1% creep;
at least a 50% increase in 1250° F./100 ksi time to 0.2% creep;
at least a 50% increase in 1300° F./70 ksi time to 0.1% creep;
at least a 50% increase in 1300° F./70 ksi time to 0.2% creep;
at least a 50% increase in 1350° F./30 ksi time to 0.1% creep; and
at least a 50% increase in 1350° F./30 ksi time to 0.2% creep.

21. The method of claim 20 wherein:
the improved properties include at least one of:
at least a 500% increase in 1250° F./100 ksi time to 0.2% creep;
at least a 500% increase in 1300° F./70 ksi time to 0.2% creep; and
at least a 500% increase in 1350° F./30 ksi time to 0.2% creep.

22. The method of claim 20 wherein:
the improved properties are accompanied by no more than a 10% decrease in at least one of 1200° F. yield strength and ultimate tensile strength.

23. The method of claim 20 wherein:
the improved properties include at least four of:
at least a 50% increase in 1350° F./78 ksi rupture life;
at least a 50% increase in 1250° F./100 ksi time to 0.1% creep;
at least a 50% increase in 1250° F./100 ksi time to 0.2% creep;
at least a 50% increase in 1300° F./70 ksi time to 0.1% creep;
at least a 50% increase in 1300° F./70 ksi time to 0.2% creep;
at least a 50% increase in 1350° F./30 ksi time to 0.1% creep; and
at least a 50% increase in 1350° F./30 ksi time to 0.2% creep.

* * * * *